US007403628B2

(12) United States Patent
Murray

(10) Patent No.: US 7,403,628 B2
(45) Date of Patent: Jul. 22, 2008

(54) TRANSDUCER ASSEMBLY AND LOUDSPEAKER INCLUDING RHEOLOGICAL MATERIAL

(75) Inventor: Matthew J. Murray, Raleigh, NC (US)

(73) Assignee: Sony Ericsson Mobile Communications AB, Lund (SE)

( * ) Notice: Subject to any disclaimer, the term of this patent is extended or adjusted under 35 U.S.C. 154(b) by 338 days.

(21) Appl. No.: 10/709,010

(22) Filed: Apr. 7, 2004

(65) Prior Publication Data

US 2005/0226445 A1 Oct. 13, 2005

(51) Int. Cl.
*H04R 25/00* (2006.01)

(52) U.S. Cl. ..... 381/152; 381/431

(58) Field of Classification Search ..... 381/152, 381/333, 386, 388, 396, 398, 190, 412, 413, 381/423, 431, 353, 354, 191; 379/430, 433.02, 379/433.12, 446

See application file for complete search history.

(56) References Cited

U.S. PATENT DOCUMENTS

| | | | | |
|---|---|---|---|---|
| 6,151,402 | A | 11/2000 | Azima et al. | |
| 6,192,136 | B1 | 2/2001 | Azima et al. | |
| 6,266,542 | B1 | 7/2001 | Stern et al. | |
| 6,332,029 | B1 | 12/2001 | Azima et al. | |
| 6,353,733 | B1 | 3/2002 | Murray et al. | |
| 6,389,935 | B1 | 5/2002 | Azima et al. | |
| 6,434,237 | B1 * | 8/2002 | Murray | 379/446 |
| 6,466,682 | B2 * | 10/2002 | An | 381/413 |
| 6,522,760 | B2 | 2/2003 | Azima et al. | |
| 6,606,390 | B2 | 8/2003 | Azima | |
| 2002/0064290 | A1 | 5/2002 | Reynaga et al. | |
| 2002/0193137 | A1 | 12/2002 | Bank et al. | |
| 2003/0059069 | A1 | 3/2003 | Bank et al. | |
| 2003/0059080 | A1 | 3/2003 | Backman | |
| 2005/0157904 | A1 * | 7/2005 | Steere et al. | 381/431 |

OTHER PUBLICATIONS

Sony Ericsson Mobile Communications AB, International Application No. PCT/US2004/038031, Written Opinion, Mar. 30, 2005.

Sony Ericsson Mobile Communications AB, International Application No. PCT/US2004/038031, International Search Report, Mar. 30, 2005.

(Continued)

*Primary Examiner*—Huyen D. Le
(74) *Attorney, Agent, or Firm*—Matthew W. Witsil; Moore & Van Allen PLLC

(57) ABSTRACT

A transducer assembly includes a transducer and a coupler with rheological material. A loudspeaker further includes an acoustic radiator. The coupler is mounted to the transducer and is operatively connected to the acoustic radiator. The transducer excites bending waves in the acoustic radiator to produce an acoustic output. By control of the rheological material, which may include mageto-rheological liquid or electro-rheological liquid, the transducer in various embodiments may selectively be substantially rigidly or substantially flexibly coupled to the acoustic radiator. If flexibly coupled the force experienced by the transducer when the host device is dropped, jarred, or pressured may be reduced from that experienced with a rigid connection. The acoustic radiator may be, for example, a display such as an LCD or a window mounted over a display. A mobile terminal may include such a loudspeaker in accordance with one embodiment.

37 Claims, 5 Drawing Sheets

OTHER PUBLICATIONS www.maxim-ic.com/appnotes.cfm/appnote.number/988/ln/en (visited Nov. 4, 2003); Maxim Website, Driving Audio Piezoelectric Transducers.

www..elac.com/en/products/imago/dml.html (visited Nov. 4, 2003).

www.murata-northamerica.com/murata/murata.nsf/pdf/addproducts/$file/techbriefprezo042302.pdf(visited Nov. 4, 2003); MuRata's Piezoelectric Sound Components, by Shay Ashmon.

www.murata.com/catalog/p15e6.pdf (Visited Nov. 4, 2003).

www.lordcorp.com (visited Nov. 2003); Product Section.

www.nxtplc.com (visited Oct. 29, 2003); Siemens Display Speaker Case Study.

www.nxtplc.com (visited Oct. 29, 2003); NXT Distributed Mode Loudspeakers.

www.nxtplc.com (visited Oct. 29, 2003); NXT's Sound Vu Technology.

www.nxtplc.com (visited Nov. 6, 2003); DMA exciter case study.

www.nxtplc.com (visited Nov. 6, 2003); The DMA exciter.

www.dba-pr.com/clients/nxt-plc/releases/siemensphone.htm (visited Oct. 29, 2003); Major Milestone in Mobile Comms as Siemens Showcases Mobile Phone Using NXT Technology, by Franklyn Roth.

* cited by examiner

TRANSDUCER ASSEMBLY AND LOUDSPEAKER INCLUDING RHEOLOGICAL MATERIAL

BACKGROUND OF INVENTION

This invention relates to the field of acoustic devices, and more particularly to bending wave loudspeakers, also known as distributed mode loudspeakers (DMLs), including acoustic radiators and transducers.

Cellular phones, televisions, and like products often include loudspeakers having a diaphragm excited by an axially driven transducer. Such speakers are relatively large for products where space is at a premium and where there is a continual drive to reduce the size of the products. In a recently developed alternative to conventional piston-driven loudspeakers, sound may be produced by bending wave loudspeakers. Bending wave loudspeakers may use the device's display as an acoustic radiator, recognizing space savings by eliminating a relatively large conventional speaker. Further, in some cases the listening experience produced by a bending wave loudspeaker is superior to that of a conventional speaker in that the sound coming from a DML is not as localized as that produced by traditional receivers.

Bending wave loudspeakers include an acoustic radiator that is capable of supporting bending wave vibration and an electromechanical transducer mounted to the acoustic radiator. Bending wave energy may be transmitted to the acoustic radiator by a transducer, or exciter, to generate bending waves in the radiator, which may be a panel, and produce an acoustic output. The exciter is mounted to the panel, and may be a dynamic exciter such as an electromechanical moving coil or other inertial exciter, a piezoelectric exciter, or the like. A piezoelectric exciter is often preferable as compared to other types of exciters because it is generally smaller (and in particular thinner) and lighter. Piezoelectric materials, however, are also relatively brittle and fragile. Electronic acoustic devices, and particularly handheld ones, are susceptible to being dropped or otherwise jarred, and the piezoelectric material, rigidly mounted to the acoustic radiator, is subjected to impact force and possible breakage.

SUMMARY OF INVENTION

In accordance with an embodiment of the present invention, a transducer assembly includes a transducer and a coupler. The transducer is for exciting bending waves in an acoustic radiator to produce an acoustic output. The coupler includes rheological material and is mounted to the transducer. The coupler is further adapted to be operatively connected to the acoustic radiator to transmit bending wave energy from the transducer to the acoustic radiator. Accordingly, by control of the rheological material, when installed in a device the transducer may selectively be substantially rigidly or substantially flexibly coupled to the acoustic radiator, and if substantially flexibly coupled the force experienced by the transducer when the device is dropped, jarred, or pressured may be reduced from that experienced with a substantially rigid connection.

In accordance with another embodiment of the present invention, a transducer assembly includes a piezoelectric transducer to excite bending waves in an acoustic radiator to produce an acoustic output. The magneto-rheological fluid has a controllable viscosity that increases in response to the magnetic field, such that the coupler is substantially flexible in the absence of the magnetic field and is substantially rigid in the presence of the magnetic field. A coupler including foam impregnated with a magneto-rheological fluid is mounted to the transducer. The coupler is also adapted to be operatively connected to the acoustic radiator to transmit bending wave energy from the transducer to the acoustic radiator. The transducer assembly also includes a magnet for generating a magnetic field through the coupler.

In accordance with another embodiment of the present invention, a loudspeaker includes an acoustic radiator adapted to support bending wave vibration. A transducer is provided to excite bending waves in the acoustic radiator to produce an acoustic output. A coupler including rheological material is operatively connected to the acoustic radiator and the transducer to transmit bending wave energy from the transducer to the acoustic radiator.

In accordance with another embodiment of the present invention, a loudspeaker includes an acoustic radiator adapted to support bending wave vibration, and may be a display or a window mounted over a display. A piezoelectric transducer is provided to excite bending waves in the acoustic radiator to produce an acoustic output. A coupler including foam impregnated with rheological material is operatively connected to the acoustic radiator and the transducer to transmit bending wave energy from the transducer to the acoustic radiator. The loudspeaker also includes means for generating an energy field through the coupler. The rheological material has a controllable viscosity that increases in response to the energy field, such that the coupler is substantially flexible in the absence of the energy field and is substantially rigid in the presence of the energy field.

In accordance with another embodiment of the present invention, a mobile terminal comprises a housing and a loudspeaker mounted to the housing. The loudspeaker includes an acoustic radiator adapted to support bending wave vibration, and may be a display or a window mounted over a display. A transducer is provided to excite bending waves in the acoustic radiator to produce an acoustic output. A coupler including rheological material is operatively connected to the acoustic radiator and the transducer to transmit bending wave energy from the transducer to the acoustic radiator.

In accordance with another embodiment of the present invention, a mobile terminal comprises a housing and a loudspeaker mounted to the housing. The loudspeaker includes an acoustic radiator adapted to support bending wave vibration, and may be a display or a window mounted over a display. A piezoelectric transducer is provided to excite bending waves in the acoustic radiator to produce an acoustic output. A coupler including foam impregnated with rheological material is operatively connected to the acoustic radiator and the transducer to transmit bending wave energy from the transducer to the acoustic radiator. The loudspeaker also includes means for generating an energy field through the coupler. The rheological material has a controllable viscosity that increases in response to the energy field, such that the coupler is substantially flexible in the absence of the energy field and is substantially rigid in the presence of the energy field.

In accordance with another embodiment of the present invention, a method of making a loudspeaker includes providing an acoustic radiator adapted to support bending wave vibration. A transducer is provided to excite bending waves in the acoustic radiator to produce an acoustic output. A coupler including rheological material is operatively connected to the acoustic radiator and to the transducer to transmit bending wave energy from the transducer to the acoustic radiator. Means are provided for generating an energy field through the coupler, and wherein the rheological material has a controllable viscosity that increases in response to the energy field, such that the coupler is substantially flexible in the absence of the energy field and is substantially rigid in the presence of the energy field.

In accordance with another embodiment of the present invention, a method of producing sound with a device includes sending an electrical audio signal to a transducer to create bending wave energy. An energy field is generated to cause a coupler including rheological material to become substantially rigid. Bending wave energy is transmitted from the transducer through the coupler to an acoustic radiator to excite bending waves to produce an acoustic output. The method may further include reducing the strength of the energy field to cause the coupler to become substantially flexible.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DETAILED DESCRIPTION

Figure 1:
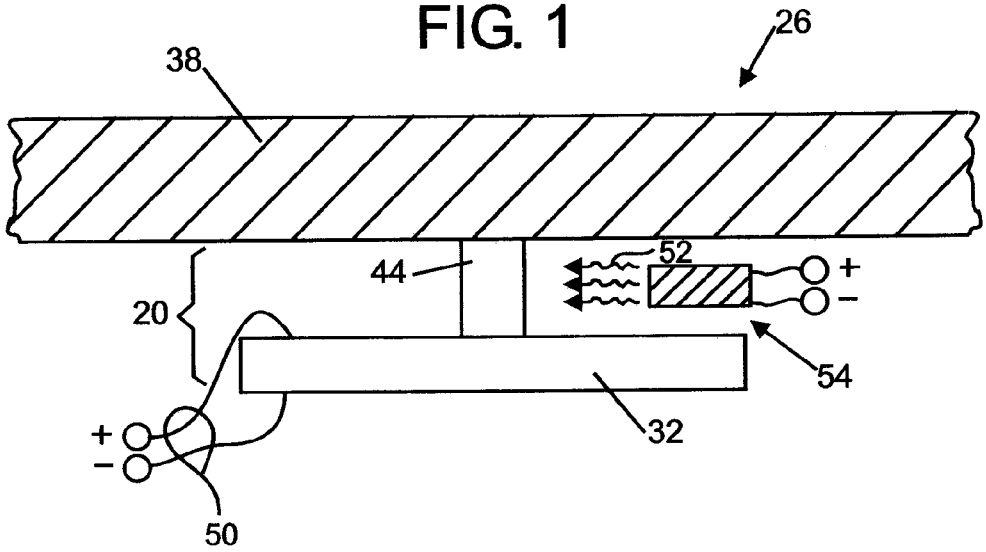
FIGS. 1-2 are side views of loudspeakers including magneto-rheological material in accordance with embodiments of the present invention.
Figure 2:
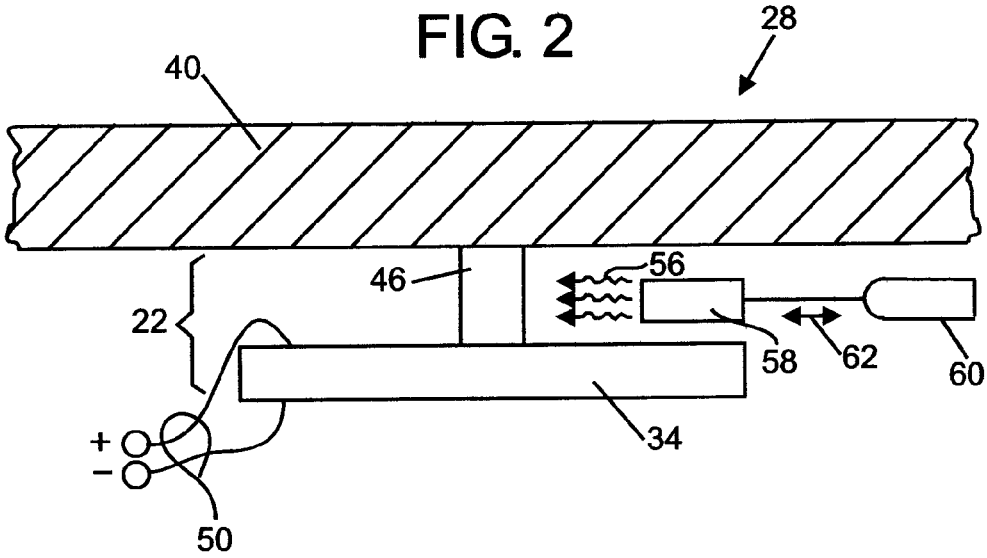
Figure 3:
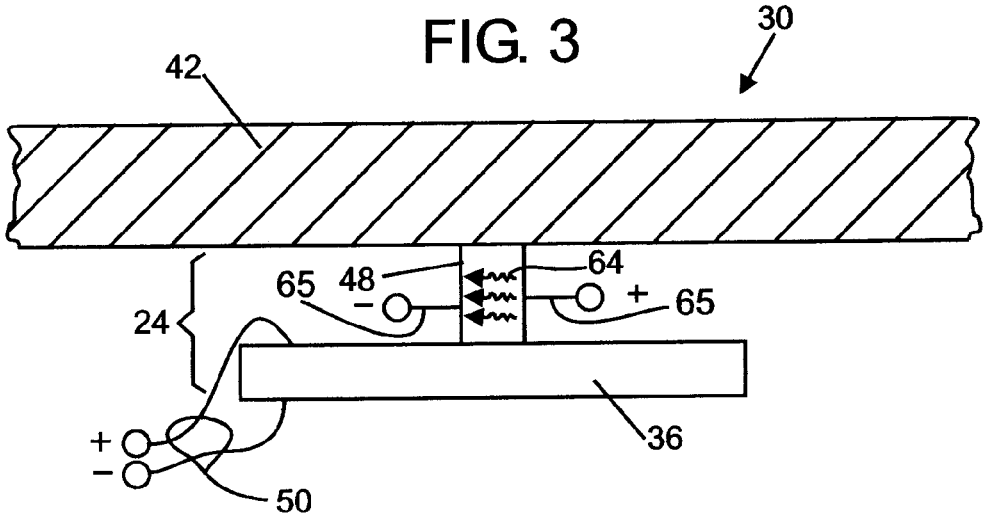
FIG. 3 is a side view of a loudspeaker including electro-rheological material in accordance with embodiments of the present invention.

FIGS. 1-3 each illustrate a transducer assembly 20, 22, 24 and loudspeaker 26, 28, 30 in accordance with embodiments of the present invention. Specifically, these figures show loudspeakers 26, 28, 30 each including a transducer 32, 34, 36 mounted to an acoustic radiator 38, 40, 42 via a coupler 44, 46, 48. The transducer assemblies 20, 22, 24 each include the transducer 32, 34, 36 and the coupler 44, 46, 48. The transducers 32, 34, 36 have an intended operative frequency range and include a resonant element having a distribution of modes in the operative frequency range. The resonant element may be active, such as a piezoelectric transducer. Alternatively, the transducer 32, 34, 36 may be passive, with the transducer 32, 34, 36 further including an active transducer such as an inertial or grounded vibration transducer, for example, a moving coil transducer.

For the purposes of illustration herein the resonant elements are shown as piezoelectric transducers 32, 34, 36. The piezoelectric transducers 32, 34, 36 may be various shapes, including but not limited to beams, plates, and disks. The piezoelectric transducers 32, 34, 36 may be opaque or, for example, transparent material such as PZLT used with thin film electrodes. As known in the art, voltage across the piezoelectric transducers 32, 34, 36 applied through electric leads 50 attached to the electrodes on each side of the transducers 32, 34, 36 control the direction and magnitude of bending. Alternating the positive and ground terminals causes bending in alternate directions, and may be selected as desired for a particular application.

The acoustic radiator 38, 40, 42 may be a panel that is capable of supporting bending wave energy from the transducer 32, 34, 36 that is transmitted through the coupler 44, 46, 48. The panel may be a distributed mode panel, may be at least in part transparent, and may be a display. Plates made of glass, polycarbonate, acrylic, and plastic, as well as liquid crystal displays (LCDs), and LCDs incorporating thin film transistors are examples of materials that may serve as acoustic radiators 38, 40, 42. The acoustic radiator 38, 40, 42 may be a window mounted over a display. The scope of the invention is not intended to be limited by materials listed herein, but may be carried out using any materials that allow the construction and operation of the present invention. Materials and dimensions depend on the particular application.

The coupler 44, 46, 48 is shown in the form of a stub and may be mounted to the transducer 32, 34, 36 and acoustic radiator 38, 40, 42 with an adhesive such as an epoxy or similar material. Examples of materials used for conventional stubs as known in the art include rigid foam plastics or other hard plastics, or metal having suitable insulating layers to prevent electrical short circuits. Known stubs generally remain stiff at all times. The coupler 44, 46, 48 of the present invention includes rheological material. The term "rheological material" as used herein refers to both magneto-rheological materials and electro-rheological materials. As known to one of skill in the art, a rheological material exhibits a significant change in its ability to flow or shear upon the application of an appropriate energy field. A rheological material having a controllable viscosity may be disposed within the coupler 44, 46, 48. The viscosity of the rheological material increases in response to an energy field. Accordingly, the coupler 44, 46, 48 is substantially flexible in the absence of the energy field or if the energy field is too weak to make the coupler 44, 46, 48 rigid, and is substantially rigid in the presence of an energy field of sufficient strength to cause such a result. The coupler 44, 46, 48 is substantially flexible when lacking sufficient rigidity to transfer bending wave energy to an acoustic radiator to produce audible sound. Conversely, the coupler 44, 46, 48 is substantially rigid when having sufficient rigidity to transfer bending wave energy to an acoustic radiator to produce audible sound. The coupler 44, 46, 48 may be, for example, closed-cell foam impregnated with rheological material, a compliant vessel made of material such as rubber and containing rheological material, or the like.

FIGS. 1-3 also illustrate example energy field sources. In FIG. 1 the rheological material is magneto-rheological fluid, and the energy field is a magnetic field 52 produced by an electromagnet 54. Similarly, in FIG. 2 the rheological material is magneto-rheological fluid, but with the magnetic field 56 produced by a permanent magnet 58. The permanent magnet 58 may move between at least two positions: one in proximity to the coupler 46 that subjects the coupler 46 to the magnetic field 56, and another farther away from the coupler 46 where the coupler 46 is substantially out of range of the magnetic field 56. A solenoid 60 or the like may control the position of the magnet 58 as shown by the arrow 62. Magneto-rheological fluids are responsive to the presence of a magnetic field 52, 56 for changing their ability to flow or shear. Magneto-rheological fluids are typically suspensions of micron sized magnetizable particles in a liquid such as oil. In the absence of a magnetic field, a magneto-rheological fluid is a free-flowing liquid that may have a consistency similar to motor oil. When exposed to a magnetic field of sufficient strength, the magnetizable particles align and reduce the ability of the magneto-rheological fluid to flow. The shear resistance of the magneto-rheological fluid is a function of the magnitude of the applied magnetic field. One example of a magneto-rheological material may be available from Lord Corporation in Cary, N.C. under the name of RHEONETIC™ magnetic fluids.

In FIG. 3 the rheological material is electro-rheological fluid, and the energy field is an electric field 64 produced by applying a voltage across the coupler 48. The electric field 64 may be generated by either directly connecting electric leads 65 to the coupler 48 or by placing an electrode and ground proximate to the coupler 48. Electro-rheological fluids are responsive to the presence of an electric field for changing their ability to flow or shear. In the absence of an electric field, an electro-rheological fluid is a free-flowing liquid. When exposed to an electric field of sufficient strength, fibrous structures form and align, reducing the ability of the electro-rheological fluid to flow. The shear resistance of the electro-rheological fluid is a function of the magnitude of the applied electric field. Lithium polymethacrylate is one example of an electro-rheological fluid.

As is apparent from the above description, when an energy field is generated through a coupler, the coupler is substantially rigid and bending wave energy may be transmitted to the acoustic radiator. When the energy field is not present or is not of sufficient strength to make the coupler substantially rigid, the coupler is substantially flexible. This flexibility may be able to be enhanced by impregnating fluid in closed-cell foam gaskets and the like. This type of implementation may be preferable in high-speed impact situations, as the time of reaction in the impact case may not be fast enough with free-flowing fluid. In cases where the loading force is slower, such as a massive object being placed on the acoustic radiator (causing large deflections) a flowing fluid may be more likely to function as desired. Flexibility in the coupler may be advantageous in situations where the device in which the loudspeaker resides is not in use. For example, when a mobile terminal such as a cellular phone is not in on a call (i.e. receiving or transmitting radio signals), it may be particularly subject to being dropped, jarred, or pressured. The phone may be configured to not generate an energy field at those times, and the flexibility in the coupler may help to avoid breakage of the transducer that may result from impact force transmitted through the acoustic radiator.

Although the embodiments of FIGS. 1-3 show a single coupler 44, 46, 48 being mounted to the proximate surface of the acoustic radiator 38, 40, 42, other mounting configurations are possible. Examples of other embodiments are shown in FIGS. 4-10. In the embodiments of FIGS. 1-10, for example, it should be understood that as known by one of skill in the art that mass, such as plastic material or the like, may be added to the embodiments described herein at selected locations on the piezoelectric transducers in order to increase the magnitude of or control the vibration imparted to the respective acoustic radiators. Locations for such mass, for example, may be on the edges or periphery of centrally mounted transducers as discussed below for FIG. 4, or at a central point on transducers that are edge mounted as discussed below for FIGS. 6 and 7. In the embodiments of FIGS. 4-10 one or more couplers including rheological material in the form of stubs are used. A magnetic field 66 is shown as the energy field on each figure; it should be understood that the field could instead be an electric field through the coupler, and that the magnetic field source, also not shown, may include an electromagnet, permanent magnet, or the like.

Figure 4:
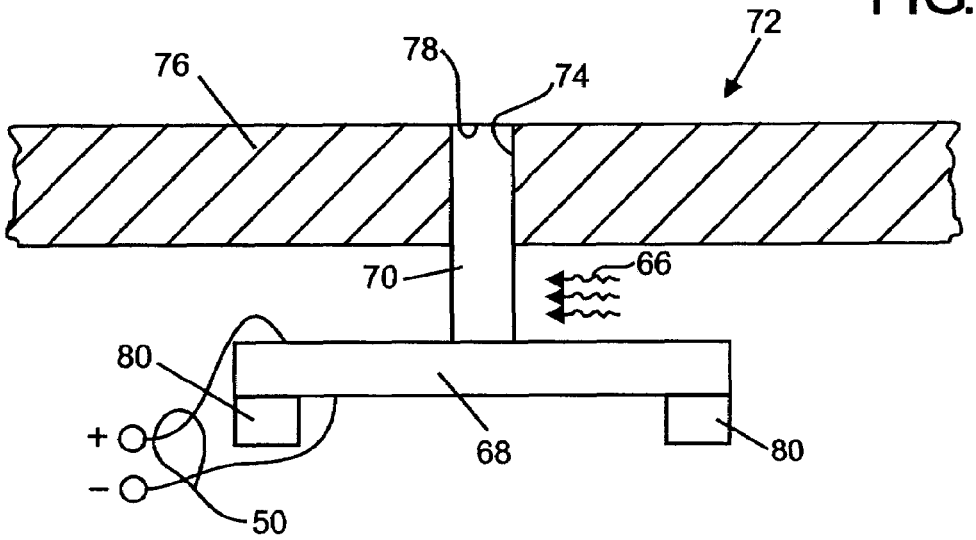
FIGS. 4-10 are side views of loudspeakers including rheological material in accordance with additional embodiments of the present invention.

FIG. 4 shows a piezoelectric transducer 68 mounted at its center to a coupler 70 including rheological material in accordance with an embodiment of a loudspeaker 72 according to the present invention. The coupler 70 extends into an aperture 74 in an acoustic radiator 76 and is mounted to the inside surface 78 of the side of the radiator 76 distal from the transducer 68. A mass 80 may be mounted to the ends of the transducer 68 if the transducer 68 is a beam, or to the periphery as an annular ring if the transducer 68 is a disk as shown.

Figure 5:
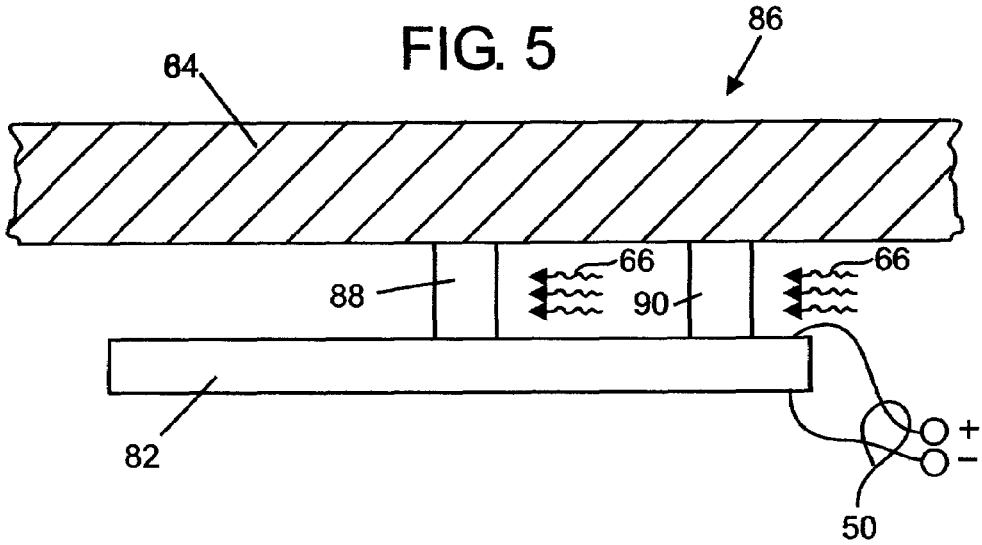

FIG. 5 shows a beam-type transducer 82 mounted an acoustic radiator 84 in accordance with an embodiment of a loudspeaker 86 according to the present invention. Two couplers 88, 90 including rheological material are used to couple the transducer 82 to the acoustic radiator 84. One coupler 90 is located towards one end of the transducer 82 and the other 88 is located towards the center of the transducer 82.

Figure 6:
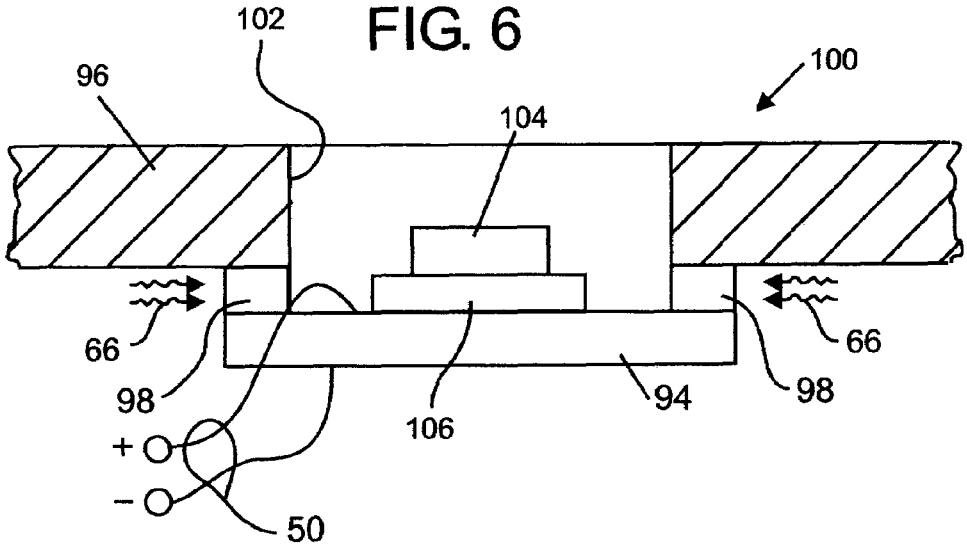
Figure 7:
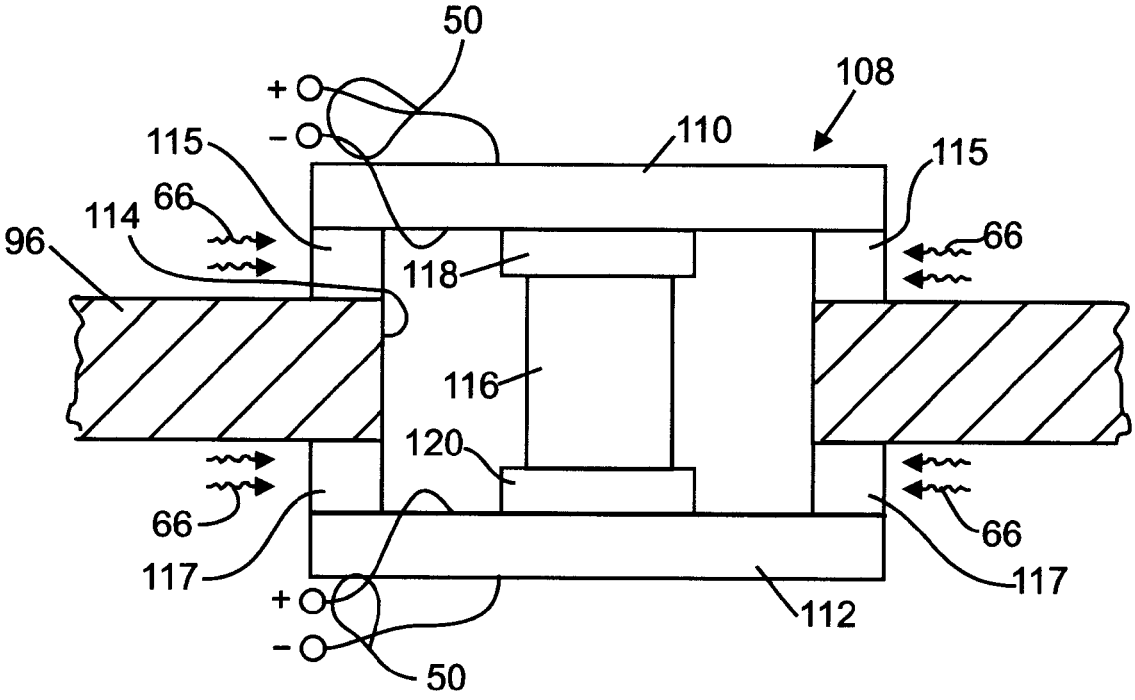

FIG. 6 shows a disk-type transducer 94 coupled along its periphery to the surface of an acoustic radiator 96 by an annular-shaped coupler 98 in accordance with an embodiment of a loudspeaker 100 according to the present invention. Again, the coupler 98 includes rheological material. The central portion of the transducer 94 is suspended over a cavity 102 in the radiator 96. A mass 104 may be provided with a damping pad 106 of resilient material such as an elastic polymer interposed between the mass 104 and the transducer 94. FIG. 7 is an embodiment of a loudspeaker 108 similar to that of FIG. 6, with a mirror-image transducer 110 added to the single transducer 112, mounted to the opposite sides of a cavity 114 in the radiator 96, and may operate in push/pull mode. Annular shaped couplers 115, 117 are interposed between the transducers 110, 112 and the radiator 96. The transducers 110, 112 are coupled to a common mass 116, with a damping pad 118, 120 between each transducer 110, 112 and the mass 116.

Figure 8:
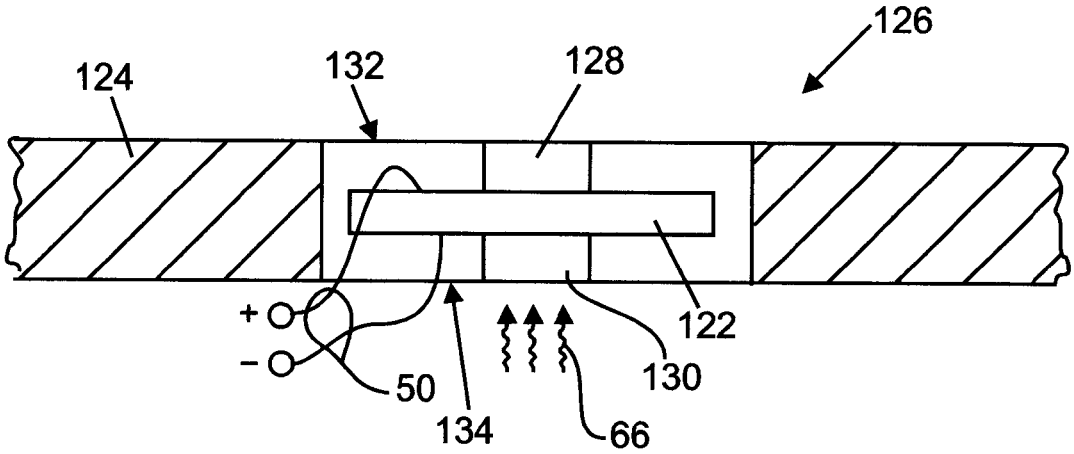

FIG. 8 shows a piezoelectric transducer 122 within an acoustic radiator 124 in accordance with an embodiment of a loudspeaker 126 according to the present invention. Couplers 128, 130 including rheological material are disposed on each side of the transducer 122 to transmit vibration to each of the skins 132, 134 of the radiator 124.

Figure 9:
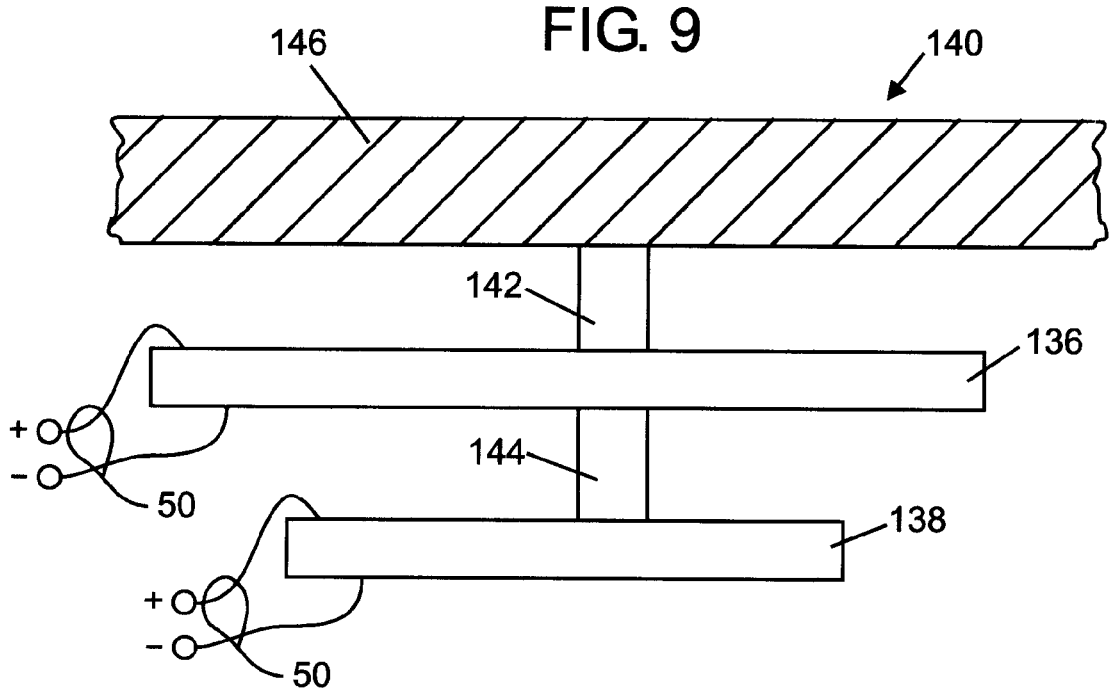

FIG. 9 shows stacked elements 136, 138 in accordance with an embodiment of a loudspeaker 140 according to the present invention. The elements 136, 138 may both be active, such as piezoelectric transducers, or one may be active and the other passive. Couplers 142, 144 may both include rheological material, but only one coupler 142, 144 in between an acoustic radiator 146 and the piezoelectric transducer need include rheological material. An energy field (not shown) may be applied to any coupler 142, 144 that includes rheological material. The couplers 142, 144 may be located off-center as shown.

Figure 10:
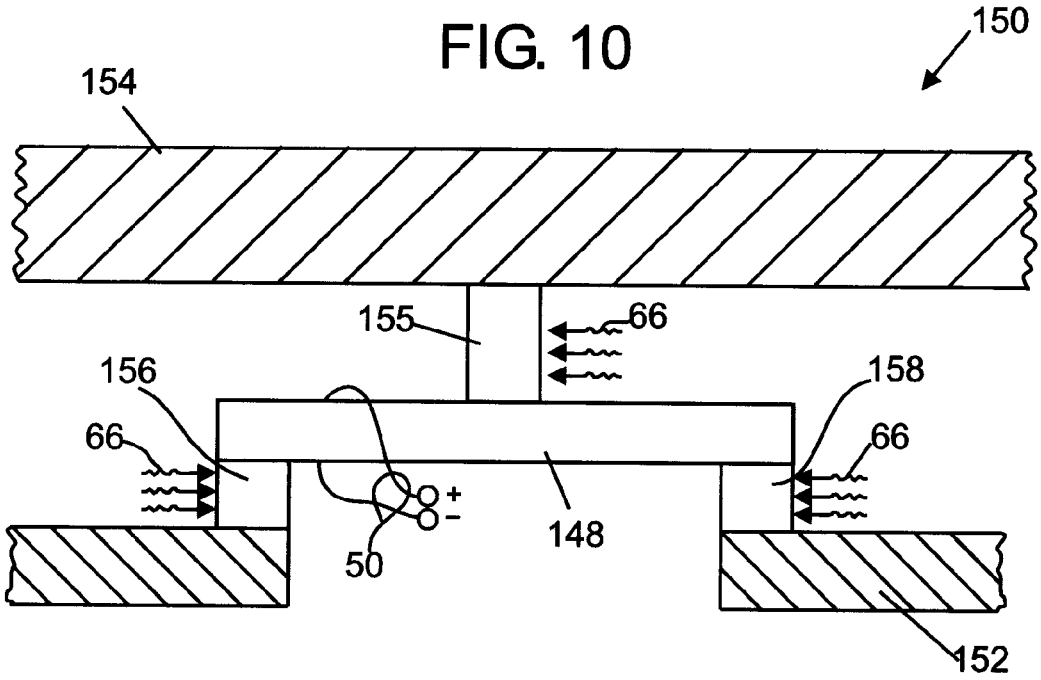

FIG. 10 shows a grounded transducer 148 in accordance with an embodiment of a loudspeaker 150 according to the present invention. A transducer is grounded when it is coupled to a supporting structure of the assembly. A supporting structure 152 provides a reaction force against the edges of the transducer 148, making the displacement of the transducer 148 be fully applied to an acoustic radiator 154. A coupler 155 is disposed between the transducer 148 and the acoustic radiator 154. If the transducer 148 is a beam, two couplers 156, 158 including rheological material may be used as shown, with one at each end of the beam. If the transducer 148 is disk-shaped a coupler including rheological material may be annular for mounting the periphery of the disk to the supporting structure 152.

Figure 11:
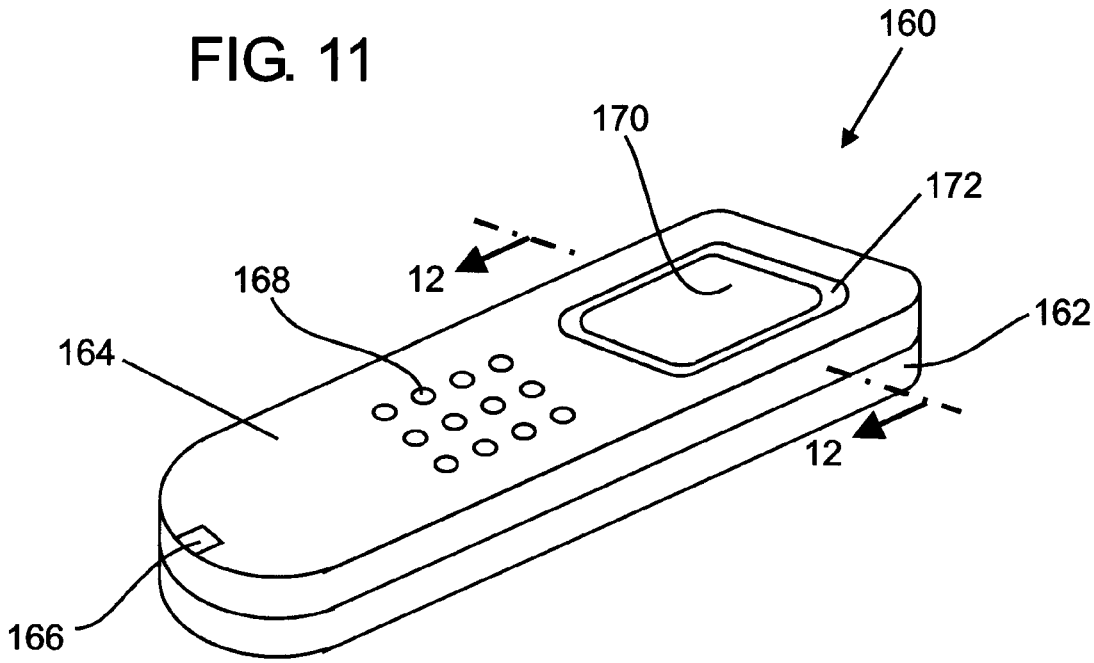
FIG. 11 is a perspective view of a mobile terminal in accordance with another embodiment of the present invention.
Figure 12:
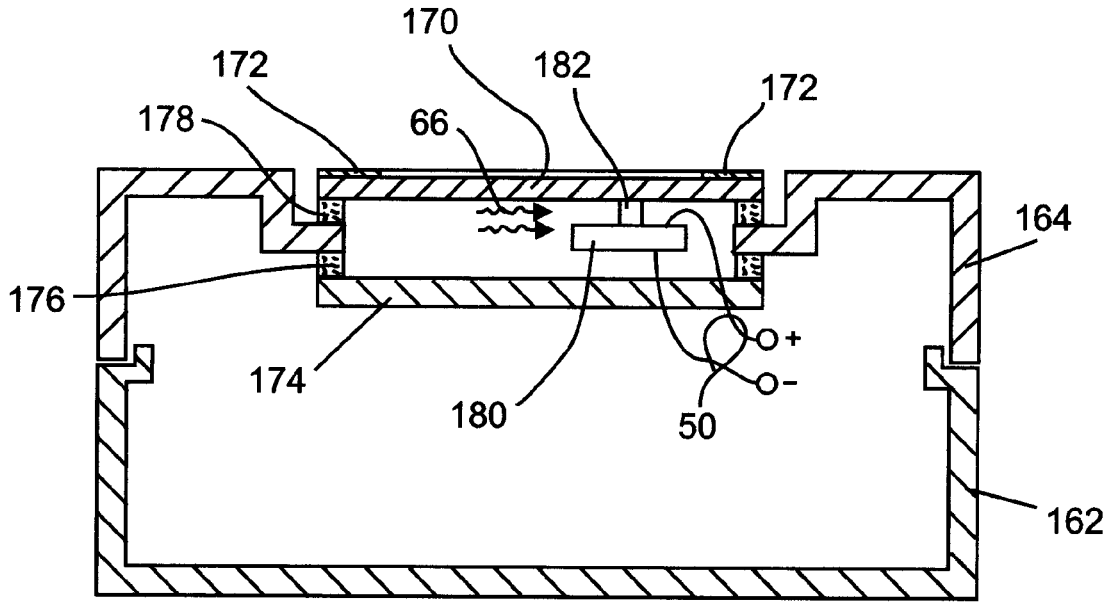
FIG. 12 is a section view of the mobile terminal of FIG. 11 taken along line 12-12 of FIG. 11.

FIGS. 11 and 12 show a mobile terminal 160 in accordance with an embodiment according to the present invention. As used herein, the term "mobile terminal" may include, among other things, a cellular radiotelephone with or without a multi-line display, a Personal Communications System (PCS) terminal that may combine a cellular radiotelephone with data processing, facsimile and data communications capabilities; a PDA that can include a radiotelephone, pager, Internet/intranet access, Web browser, organizer, calendar and/or a global positioning system (GPS) receiver; a conventional laptop and/or palmtop receiver or other appliance that includes a radiotelephone transceiver; and a personal music playback system such as for CDs, minidisks, MP-3 files, memory sticks, or the like. The mobile terminal 160 includes a back part 162 and a front part 164 that supports a microphone 166, keypad 168, and a display window 170. The display window 170 has an opaque surrounding portion 172. A display 174 (FIG. 12) is supported on the front part 164 by a suspension 176 that is fitted around the periphery of the display 174, which may be, for example, an LCD display. The display window 170 is similarly mounted to the front part 164 with a suspension 178. In the section view of FIG. 12 a transducer 180 is shown mounted to the display window 170 that is mounted over the display 174. The transducer 180 is mounted with a coupler 182 including rheological material to the opaque area 172 of the display window 170 to shield the transducer 180 from view.

One of ordinary skill in the acoustic arts will quickly recognize that the invention has other applications in other environments. It will also be understood by someone of ordinary skill in the art that the mounting geometries of the transducers to acoustic radiators discussed and illustrated herein are not necessarily the most efficient or desirable to create a desired acoustic output. In fact, many embodiments and implementations are possible. For example, the mounting location of a transducer and coupler on an acoustic radiator and the mounting location of a coupler on a transducer may be varied from those discussed without departing from the scope of the present invention. Various types of transducers, couplers, and acoustic radiators may be used. The following claims are in no way intended to limit the scope of the invention to the specific embodiments described. It should be understood by those skilled in the art that the foregoing modifications as well as various other changes, omissions and additions may be made without parting from the spirit and scope of the present invention.

What is claimed is:

1. A transducer assembly comprising:

a transducer adapted to excite bending waves in an acoustic radiator to produce an acoustic output; and a coupler including rheological material, the coupler mounted to the transducer and adapted to be attached to the acoustic radiator to transmit bending wave energy from the transducer through the coupler to the acoustic radiator.

2. The transducer assembly of claim 1, wherein the rheological material is magneto-rheological fluid and further comprising a magnet for generating a magnetic field through the coupler, and wherein the magneto-rheological fluid has a controllable viscosity that increases in response to the magnetic field, such that the coupler is substantially flexible in the absence of the magnetic field and is substantially rigid in the presence of the magnetic field.

3. The transducer assembly of claim 2, wherein the magnet is an electromagnet.

4. The transducer assembly of claim 1, wherein the rheological material is electro-rheological fluid and further comprising electric leads adapted to generate an electric field through the coupler, and wherein the electro-rheological fluid has a controllable viscosity that increases in response to the electric field, such that the coupler is substantially flexible in the absence of the electric field and is substantially rigid in the presence of the electric field.

5. The transducer assembly of claim 1, wherein the transducer includes a piezoelectric element.

6. The transducer assembly of claim 1, wherein the coupler comprises foam impregnated with rheological material.

7. The transducer assembly of claim 1, wherein the coupler comprises a closed vessel including a compliant body containing rheological material.

8. The transducer assembly of claim 1, further comprising the acoustic radiator adapted to support bending wave vibration.

9. The transducer assembly of claim 8, further comprising means for generating an energy field through the coupler, and wherein the rheological material has a controllable viscosity that increases in response to the energy field, such that the coupler is substantially flexible in the absence of the energy field and is substantially rigid in the presence of the energy field.

10. The transducer assembly of claim 8, wherein the acoustic radiator is at least in part transparent.

11. The transducer assembly of claim 10, wherein the acoustic radiator includes a display.

12. The transducer assembly of claim 11, wherein the display is a liquid crystal display.

13. The transducer assembly of claim 8, further comprising a display and a window mounted over the display, wherein the window is the acoustic radiator.

14. The transducer assembly of claim 8, wherein the transducer includes a piezoelectric element.

15. The transducer assembly of claim 8, wherein the coupler comprises foam impregnated with rheological material.

16. A mobile terminal comprising the transducer assembly of claim 8 and a housing, wherein the acoustic radiator, transducer, and coupler make up a loudspeaker that is mounted to the housing, wherein the acoustic radiator is selected from the group consisting of a display and a window mounted over a display, and wherein the coupler is attached to the acoustic radiator and the transducer to transmit bending wave energy from the transducer through the coupler to the acoustic radiator.

17. The mobile terminal of claim 16, wherein the rheological material is magneto-rheological fluid and further comprising a magnet for generating a magnetic field through the coupler, and wherein the magneto-rheological fluid has a controllable viscosity that increases in response to the magnetic field, such that the coupler is substantially flexible in the absence of the magnetic field and is substantially rigid in the presence of the magnetic field.

18. The mobile terminal of claim 17, wherein the magnet is an electromagnet.

19. The mobile terminal of claim 16, wherein the rheological material is electro-rheological fluid and further comprising electric leads adapted to generate an electric field through the coupler, and wherein the electro-rheological fluid has a controllable viscosity that increases in response to the electric field, such that the coupler is substantially flexible in the absence of the electric field and is substantially rigid in the presence of the electric field.

20. The mobile terminal of claim 16, wherein the display is a liquid crystal display.

21. The mobile terminal of claim 16, wherein the transducer includes a piezoelectric element.

22. The mobile terminal of claim 16, wherein the coupler comprises foam impregnated with rheological material.

23. A transducer assembly comprising:

a transducer adapted to excite bending waves in an acoustic radiator to produce an acoustic output;

a coupler including rheological material, the coupler mounted to the transducer and adapted to be operatively connected to the acoustic radiator to transmit bending wave energy from the transducer to the acoustic radiator, wherein the rheological material is magneto-rheological fluid that has a controllable viscosity that increases in response to the magnetic field, such that the coupler is substantially flexible in the absence of the magnetic field and is substantially rigid in the presence of the magnetic field; and a magnet for generating a magnetic field through the coupler, wherein the magnet is a permanent magnet; and means for moving the permanent magnet between first and second positions, the first position disposed relative to the coupler such that the magnetic field passes through the coupler with sufficient strength to make the coupler substantially rigid, and the second position disposed relative to the coupler such that the magnetic field does not pass through the coupler with sufficient strength to make the coupler substantially rigid.

24. The transducer assembly of claim 23, wherein the means for moving the permanent magnet comprises a solenoid.

25. A transducer assembly comprising:

a piezoelectric transducer adapted to excite bending waves in an acoustic radiator to produce an acoustic output;

a coupler including foam impregnated with a magneto-rheological fluid, the coupler mounted to the transducer and adapted to be operatively connected to the acoustic radiator to transmit bending wave energy from the transducer through the coupler to the acoustic radiator; and a magnet for generating a magnetic field through the coupler, wherein the magneto-rheological fluid has a controllable viscosity that increases in response to the magnetic field, such that the coupler is substantially flexible in the absence of the magnetic field and is substantially rigid in the presence of the magnetic field.

26. A transducer assembly comprising:

an acoustic radiator adapted to support bending wave vibration;

a transducer adapted to excite bending waves in the acoustic radiator to produce an acoustic output;

a coupler; and means for generating an energy field through the coupler, wherein the acoustic radiator is selected from the group consisting of a display and a window mounted over a display, wherein the transducer is a piezoelectric transducer, wherein the coupler includes foam impregnated with rheological material and the coupler is operatively connected to the acoustic radiator and the transducer to transmit bending wave energy from the transducer to the acoustic radiator, and wherein the rheological material has a controllable viscosity that increases in response to the energy field, such that the coupler is substantially flexible in the absence of the energy field and is substantially rigid in the presence of the energy field.

27. A mobile terminal comprising:

a transducer adapted to excite bending waves in an acoustic radiator to produce an acoustic output;

a coupler including foam impregnated with rheological material and the coupler is operatively connected to the acoustic radiator and the transducer to transmit bending wave energy from the transducer to the acoustic radiator;

an acoustic radiator adapted to support bending wave vibration;

means for generating an energy field through the coupler; and a housing, wherein the acoustic radiator is selected from the group consisting of a display and a window mounted over a display, wherein the transducer is a piezoelectric transducer, wherein the rheological material has a controllable viscosity that increases in response to the energy field, such that the coupler is substantially flexible in the absence of the energy field and is substantially rigid in the presence of the energy field, and wherein the acoustic radiator, transducer and coupler make up a loudspeaker that is mounted to the housing.

28. A method of making a transducer assembly, comprising:

providing an acoustic radiator adapted to support bending wave vibration;

providing a transducer to excite bending waves in the acoustic radiator to produce an acoustic output;

attaching a coupler including rheological material to the acoustic radiator and to the transducer to transmit bending wave energy from the transducer through the coupler to the acoustic radiator; and providing means for generating an energy field through the coupler, and wherein the rheological material has a controllable viscosity that increases in response to the energy field, such that the coupler is substantially flexible in the absence of the energy field and is substantially rigid in the presence of the energy field.

29. A method of producing sound with a transducer assembly, comprising:

sending an electrical audio signal to a transducer to create bending wave energy;

generating an energy field to cause a coupler including rheological material that is attached to the transducer and to an acoustic radiator to become substantially rigid; and transmitting bending wave energy from the transducer through the coupler to the acoustic radiator to excite bending waves to produce an acoustic output.

30. The method of claim 29, further comprising reducing the strength of the energy field to cause the coupler to become substantially flexible.

31. The method of claim 30, wherein generating an energy field comprises generating a magnetic field, reducing the strength of the energy field comprises reducing the strength of the magnetic field, and the rheological material is magneto-rheological fluid.

32. The method of claim 30, wherein generating an energy field comprises generating an electric field, reducing the strength of the energy field comprises reducing the strength of the electric field, and the rheological material is electro-rheological fluid.

33. The method of claim 30, wherein the transducer assembly is disposed in a mobile terminal, generating an energy field occurs when the mobile terminal is on a call, and reducing the strength of the energy field occurs when the mobile terminal is not on a call.

34. A transducer assembly comprising:

a piezoelectric transducer adapted to excite bending waves in an acoustic radiator to produce an acoustic output;

a coupler including foam impregnated with a magneto-rheological fluid, the coupler mounted to the transducer and adapted to be mounted to the acoustic radiator to transmit bending wave energy from the transducer through the coupler to the acoustic radiator; and a magnet for generating a magnetic field through the coupler, wherein the magneto-rheological fluid has a controllable viscosity that increases in response to the magnetic field, such that the coupler is substantially flexible in the absence of the magnetic field and is substantially rigid in the presence of the magnetic field.

35. The transducer assembly of claim 34, wherein the acoustic radiator includes a display.

36. The transducer assembly of claim 34, further comprising a display and a window mounted over the display, wherein the window is the acoustic radiator.

37. A transducer assembly comprising:

a housing;

an acoustic radiator adapted to support bending wave vibration;

a piezoelectric transducer adapted to excite bending waves in the acoustic radiator to produce an acoustic output;

a coupler including foam impregnated with a magneto-rheological fluid, the coupler mounted to the transducer and mounted to the acoustic radiator to transmit bending wave energy from the transducer through the coupler to the acoustic radiator; and a magnet for generating a magnetic field through the coupler, wherein the magneto-rheological fluid has a controllable viscosity that increases in response to the magnetic field, such that the coupler is substantially flexible in the absence of the magnetic field and is substantially rigid in the presence of the magnetic field, wherein the acoustic radiator, transducer, and coupler make up a loudspeaker that is mounted to the housing, and wherein the acoustic radiator is selected from the group consisting of a display and a window mounted over a display.

* * * * *